US005709032A

United States Patent [19]

Mizutani et al.

[11] Patent Number: 5,709,032

[45] Date of Patent: Jan. 20, 1998

[54] CHAIN STOP DEVICE FOR AN ELECTROMOTIVE CHAIN SAW

[75] Inventors: Makoto Mizutani; Hideki Okubo; Masaki Kondo, all of Anjo, Japan

[73] Assignee: Makita Corporation, Anjo, Japan

[21] Appl. No.: 657,627

[22] Filed: May 15, 1996

[30] Foreign Application Priority Data

May 16, 1995 [JP] Japan ..... 7-117354
Jul. 4, 1995 [JP] Japan ..... 7-168721

[51] Int. Cl.[6] ..... B27B 17/02

[52] U.S. Cl. ..... 30/382; 188/77 R

[58] Field of Search ..... 30/381, 382, 383; 83/DIG. 1; 123/198 D; 188/163, 77 R, 77 W; 192/17 R

[56] References Cited

U.S. PATENT DOCUMENTS

| | | | |
|---|---|---|---|
| 3,785,465 | 1/1974 | Johansson . | |
| 3,793,727 | 2/1974 | Moore . | |
| 3,982,616 | 9/1976 | Bidanset . | |
| 4,152,833 | 5/1979 | Phillips | 30/382 |
| 4,432,139 | 2/1984 | Kohler et al. | 30/381 |
| 4,573,556 | 3/1986 | Andreasson . | |
| 4,625,406 | 12/1986 | Fushiya et al. . | |
| 4,653,189 | 3/1987 | Andreasson | 30/382 |
| 4,680,862 | 7/1987 | Wieland et al. . | |
| 4,683,660 | 8/1987 | Schurr . | |
| 4,757,881 | 7/1988 | Jonsson et al. | 188/77 R |
| 4,782,593 | 11/1988 | Kieser et al. . | |
| 4,811,487 | 3/1989 | Takahashi et al. . | |
| 4,882,844 | 11/1989 | Stokan . | |

FOREIGN PATENT DOCUMENTS

| | | |
|---|---|---|
| 36 39 650 A1 | 6/1988 | Germany . |
| 43 30 850 A1 | 3/1995 | Germany . |

*Primary Examiner*—Hwei-Siu Payer
*Attorney, Agent, or Firm*—Davis and Bujold

[57] ABSTRACT

To provide a chain stop device for an electromotive chain saw that can quickly stop the rotation of a cutting chain when a trigger member is released. The electromotive chain saw is provided with a chain stop mechanism operated with a solenoid. When the trigger lever is released, the solenoid is energized, such that a brake force is applied by a chain stop mechanism. The chain stop mechanism is composed of a brake shoe for engaging with or disengaging from the inner periphery of a brake drum, a Y-shaped resilient member for supporting the brake shoe, a swingable lever for slidably guiding the resilient member, and a clutch disconnected when depressed by two arms of the resilient member.

19 Claims, 13 Drawing Sheets

CHAIN STOP DEVICE FOR AN ELECTROMOTIVE CHAIN SAW

FIELD OF THE INVENTION

This invention relates to a chain stop device for use in an electromotive chain saw.

BACKGROUND OF THE INVENTION

In a conventional electromotive chain saw, a hand guard for protecting an operator's hands is provided in front of a handle. Additionally, a brake band is wound around a brake drum for stopping the operation of a cutting chain. By operating the hand guard and pulling one end of the brake band, the brake drum is tightened with the brake band, thereby stopping the cutting chain.

However, in such electromotive chain saws, even after a trigger member is released and a motor drive switch is turned off, the inertial rotation of the motor often results in the rotation of the cutting chain for several seconds. If the rotating chain contacts or hits the ground it is often damaged, thereby requiring the replacement of the chain itself. The material in process is also inadvertently damaged. Furthermore, the operator cannot go to the subsequent steps of work until the chain is completely stopped. Thus, the work efficiency is deteriorated.

SUMMARY OF THE INVENTION

Wherefore, an object of the present invention is to provide a chain stop device for an electromotive chain saw that can quickly stop the rotation of a cutting chain when a trigger member is released.

To achieve this or other objects, the present invention provides a chain stop device for an electromotive chain saw provided with a cutting chain wound around a guide bar extending forwards from a housing, an electromotive motor for providing a rotary drive force via a clutch to a sprocket onto which the cutting chain is wound, and a trigger member for energizing the electromotive motor when turned on and for stopping the electromotive motor when turned off. The chain stop device is provided with a clutch release member for releasing the engagement of the clutch, a brake member for applying a brake force to a brake drum secured onto the sprocket, and a trigger link means for operating the clutch release member and the brake member when the trigger member is changed from its ON position to its OFF position.

In the chain stop device, when the trigger member is moved from its ON position to its OFF position, the trigger link means operates the clutch release member and brake member. By disconnecting the clutch, although the motor is inertially rotated, the sprocket is freed from such inertial rotation of the motor. In addition, a brake force is applied to the brake drum by the brake member. Therefore, the drive sprocket instantly halts, thereby quickly stopping the rotation of the cutting chain.

In the present invention, in addition to the application of a brake force, the engagement of the clutch is released, thereby enhancing the reliability of a brake function. In the structure, no excessive frictional force is applied to the brake device, thereby advantageously protecting the brake member from damage. The chain stop device of the present invention can fulfill its chain stopping performance stably over a long term.

In the chain stop device of the electromotive chain saw, the clutch is composed of engagement teeth formed on the brake drum, an engaging member rotated about a rotation axis by the electromotive motor and being slidable in an axial direction along the rotation axis, for engaging with the engagement teeth on the brake drum, and an urging member for urging or pushing the engaging member onto the brake drum. The clutch release member releases the engagement of the clutch by sliding the engagement member against the urging member. The engagement urging member can push or attract the engagement member toward the brake drum.

For the engagement of the clutch, the brake drum is brought in contact with the engagement member in an axial direction of along rotation axis, and the engagement teeth can be formed on each abutment face of both the brake drum and the engagement member. Alternatively, a cylindrical member is projected from the brake drum, and is provided with a spline groove, for receiving a spline connecting projection, formed on the inner periphery thereof. The cylindrical member can also be provided with the spline connecting projection formed on the inner periphery thereof for engaging with the engagement member in a spline connection.

The clutch can be formed in a frictional system. However, the aforementioned system of the clutch can bear a high load, and can efficiently transmit a drive force to the chain saw. The urging member for the engagement requires less urging force. Therefore, the engagement member can be easily pushed or pulled by the urging member. The engagement of the clutch can be quickly released.

In the chain stop device of the electromotive chain saw, the clutch release member also operates the brake member, and the engagement of the clutch is released before a brake force is applied.

In the structure, the release of the engagement of the clutch can be associated with the application of the brake force with appropriate timing. Without giving an excess load to the brake member, the cutting chain can be stopped. The release of the clutch engagement and the application of the brake force are performed with the same clutch release member. Therefore, the number of components in the chain stop device can be minimized.

In the chain stop device of the electromotive chain saw, the brake member is composed of a brake shoe for applying a brake force to a peripheral wall of the brake drum. The engagement member is provided with a jaw. The clutch release member is composed of a member slidable in a direction perpendicular to the rotation axis, and a detent is formed on the slidable member to be projected into the jaw of the engagement member. The engagement of the clutch is released when the slidable member is slid to a position in which the detent is brought in direct or indirect contact with the jaw. The brake shoe is attached to the slidable member, such that a brake force is applied to the brake drum when the detent is slid to be in direct or indirect contact with the jaw. In the structure, when the slidable member is guided in a certain direction, the release of the engagement of the clutch and the application of the brake force can be done at the same time. When the jaw is extended from the engagement member, by pushing or pulling the jaw, the engagement member, rotating together with the rotation axis, can be easily pushed back or pulled back.

The detent can be projected from the surface of or from a indentation in the engagement member. The detent is preferably provided in a position such that the engagement member is slid or guided before the brake shoe contacts the brake drum. When the detent is brought in indirect contact with the jaw, a member to be rotated or slid by the detent can be interposed between the detent and the jaw.

In the chain stop device of the electromotive chain saw, the trigger link means is composed of a trigger release detecting means for detecting that the trigger member is changed from its ON position to its OFF position, and a clutch release start means for operating the clutch release member when the trigger release detecting means detects that the trigger member is changed to its OFF position. The clutch release start means is composed of a solenoid for slidably moving the slidable member and an electric power supply means for supplying electric power to the solenoid. It can be easily detected that the trigger member is changed from its ON position to its OFF position, by detecting the condition of the conduction of electricity in the drive circuit for the electromotive motor, or by detecting a change in the position of the trigger member. Since the solenoid is provided, the clutch release member can be momentarily slid.

In the chain stop device of the electromotive chain saw, the solenoid and the slidable member are interconnected with a lever interposed therebetween, and a point of application interconnecting the lever and the slidable member is positioned between a support of the lever and a force point interconnecting the lever and the solenoid. The force of the solenoid is amplified by the action of the fulcrum. Therefore, the brake shoe can be brought in contact firmly with the brake drum. If the solenoid can provide a sufficient stroke, a smaller attractive force is required. The entire size and energy of the electromotive chain saw can be minimized.

The invention also provides a mechanical drive device.

The chain stop device for use in the electromotive chain saw is provided with a cutting chain wound around a guide bar extending forwards from a housing, an electromotive motor for providing a rotary drive force via a clutch to a sprocket onto which the cutting chain is wound, and a trigger member for energizing the electromotive motor when turned on and for stopping the electromotive motor when turned off. The chain stop device is composed of a clutch release member for releasing the engagement of the clutch, a brake member for applying a brake force to a brake drum secured onto the sprocket, and a trigger link means for operating the clutch release member and the brake member when the trigger member is moved from its ON position to its OFF position. The trigger link means is composed of a rod member mechanically connected to the trigger member for providing a stroke movement when the trigger member is operated between its ON position and its OFF position. The rod member is interconnected to the clutch release member such that the clutch release member is operated when the trigger member is moved to its OFF position.

In the mechanical structure of the chain stop device, the trigger member is operatively interconnected with the rod member, and when the rod member provides a stroke movement, the clutch release member is slid. When the trigger member is turned off, the trigger member, the rod member and the clutch release member cooperate in the release of the clutch engagement and the application of the brake force. Therefore, when the trigger member is released, the rotation of the cutting chain is instantly stopped. In addition, solenoid or other expensive and voluminous components are not required. Therefore, cost can be minimized.

In the mechanical system of the chain stop device of the electromotive chain saw, the slidable member is provided with a brake urging member for urging the brake shoe toward the brake drum. The rod member is brought in direct or indirect contact with the slidable member, such that the stroke movement of the rod member attenuates the urging force of the brake urging member when the trigger member is turned on, and the stroke movement of the rod member provides the urging force of the brake urging member when the trigger member is turned off. The provision of the brake urging member assists or accelerates the stroke movement when the trigger member is turned off, thereby quickly applying a brake force. When the solenoid is provided, the solenoid itself is energized at high speed, obviating the necessity of the brake urging member. In the mechanical system provided with the rod member, the brake force is securely, quickly and effectively applied.

In this case the rod member and the slidable member are interconnected indirectly with a lever interposed therebetween, and a point of application interconnecting the lever and the slidable member is positioned between a support of the lever and a force point interconnecting the lever and the rod member. In the same manner as the fulcrum action in the solenoid, the brake shoe can be strongly pushed onto the brake drum. In the mechanical structure, when the trigger member is turned on, a strong force is needed to counteract the force of the brake urging member. However, such a force can be reduced by the provision of the lever. Therefore, a force loaded on the fingers of a user can be advantageously minimized. Consequently, the desired object of the present invention can be attained in the mechanical structure, while the user can feel the trigger member lightly and feel some comfort in operation.

In the aforementioned chain stop device of the electromotive chain saw, a brake release means can be provided for releasing a brake force applied by the brake member before the trigger member is again moved to its ON position.

While the brake force is released, the cutting chain is accessible for maintenance. For example, the tension of the cutting chain can be easily adjusted and a cutting chain blade can be easily ground. The brake force can be applied only for a short time during which the motor is inertially rotated. After that, the sprocket can be left rotating.

In the chain stop device driven by the solenoid, after the solenoid is operated for a set time, the brake force of the brake member is released. In the mechanically driven chain stop device, the rod member can be disconnectably connected to the clutch release member. Alternatively, the rod member can be connected with the clutch release member with a large play provided therebetween. In this case the provision of a separate brake release means is required.

BRIEF DESCRIPTION OF THE DRAWINGS

The invention will now be described, by way of example, with reference to the drawings, in which.

DETAILED DESCRIPTION OF THE PREFERRED EMBODIMENTS

Figure 1:
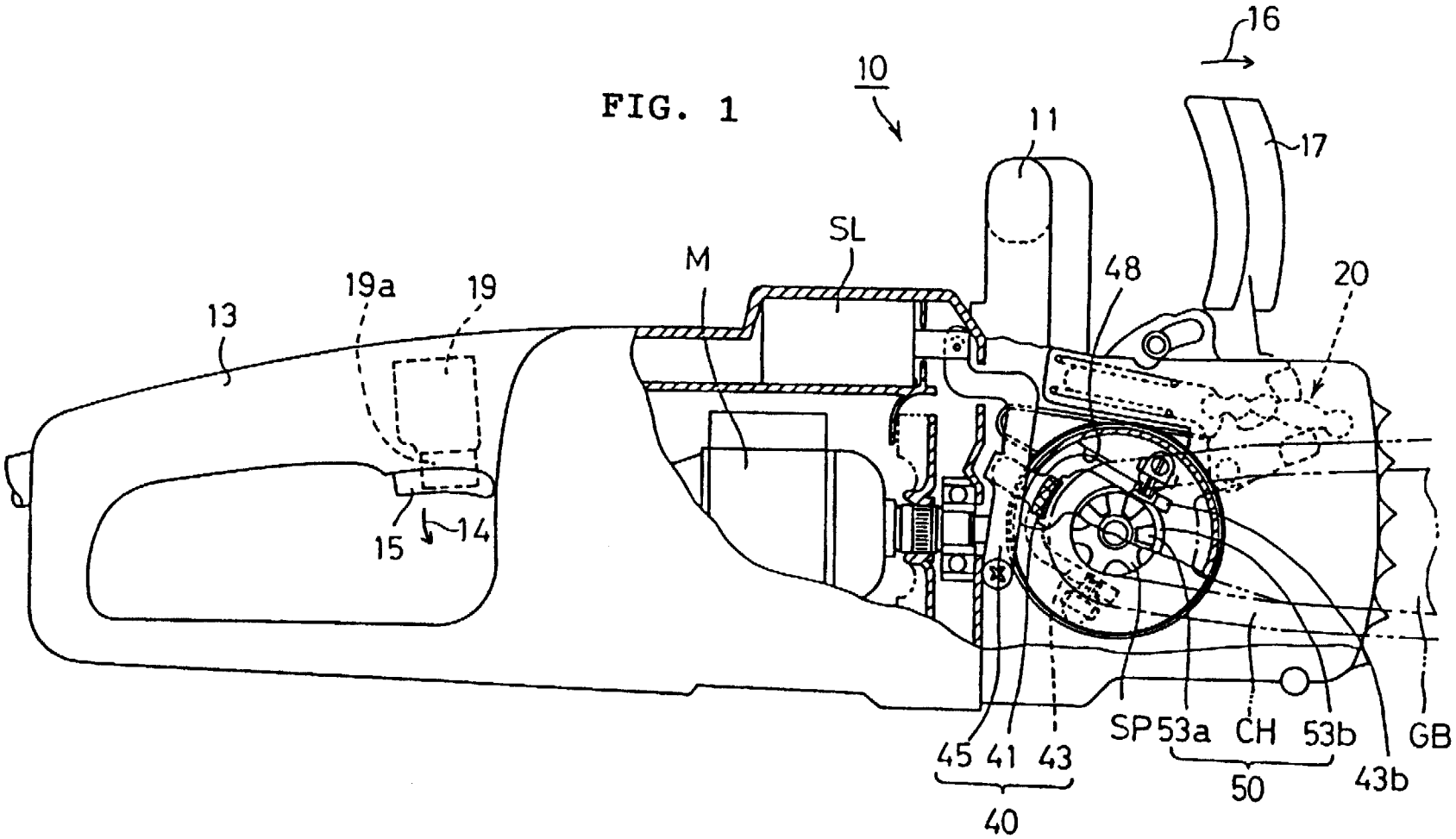
FIG. 1 is a partly broken front view of an electromotive chain saw according to a first embodiment of the invention.

As shown in FIG. 1, in an electromotive chain saw 10 of a first embodiment, a chain CH is wound around a guide bar GB extending from a housing and is driven with an electromotive motor M built in the housing. The electromotive chain saw 10 is manually held with forward and rearward handles 11, 13. The grip of the rearward handle 13 is provided with a movable trigger lever 15. A hand guard 17 is disposed in front of the forward handle 11, with a brake device 20 built therein, which is operated by turning the hand guard 17 in the direction shown by arrow 16 in FIG. 1. The trigger lever 15 is normally urged, by a spring having a switch built therein, in the direction shown by an arrow 14 in FIG. 1, and is brought in contact with a push button 19*a* of a power switch 19 of the motor M when depressed.

Figure 2:
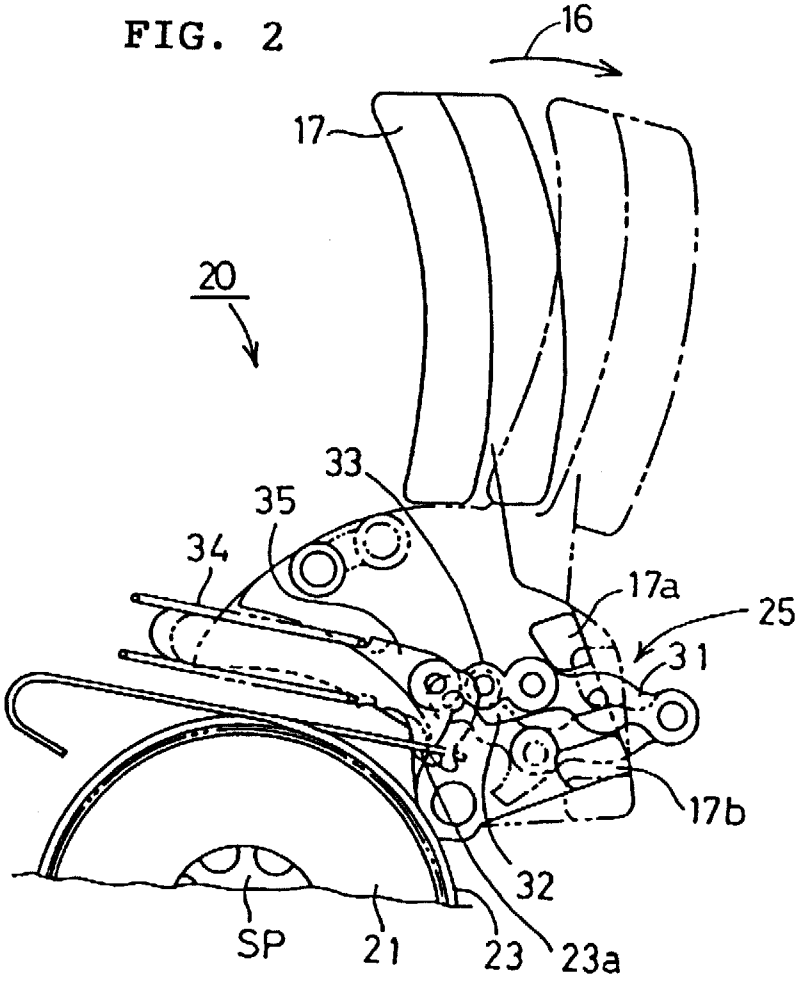
FIG. 2 is an enlarged view of a chain stop mechanism interconnected with a hand guard of the chain saw of the first embodiment.

As shown in FIG. 2, the brake device 20 applied in cooperation with the hand guard 17 is formed with a steel brake band 23 wound around a brake drum 21 securely attached onto a sprocket SP. The brake device 20 is also provided with a linkage 25 for connecting a forward end 23*a* of brake band 23 to the hand guard 17. The linkage 25 is formed with an forward end link plate 31 interposed between engagement projections 17*a*, 17*b* of hand guard 17. The forward end link plate 31 is interconnected with a middle link plate 33 by a rearward jaw 32. The middle link plate 33 is further interconnected with a rear end link plate 35 which is urged forwards by a coil spring 34.

When the hand guard 17 is in an initial position as shown by a solid line in FIG. 2, the link plates 31, 33, 35 are aligned, thereby pushing against the coil spring 34, loosening the brake band 23 and permitting the brake drum 21 to rotate. When the hand guard 17 is rotated in the direction shown by the arrow 18 in FIG. 2, the projection 17*a* of hand guard 17 lowers downward the forward end link plate 31, as shown by a two-dotted line. As a result, the middle link plate 33 is disengaged from the rearward jaw 32 and is rotated, thereby pulling the rear end link plate 35 forwards. The coil spring 34 is thus immediately extended, thereby quickly tightening the brake band 23. The brake drum 21 is forced to stop and the chain CH is also stopped.

Figure 3:
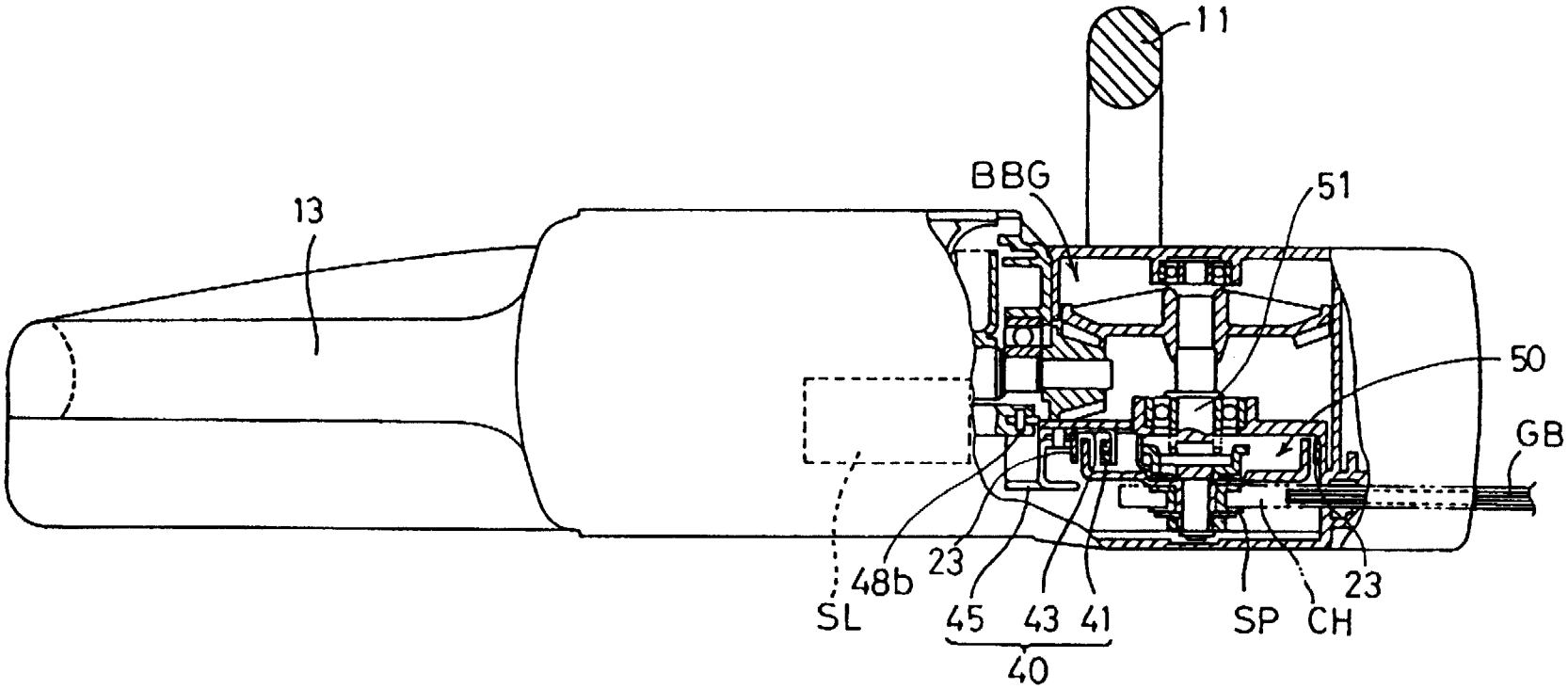
FIG. 3 is a partly broken plan view of the electromotive chain saw of the first embodiment.

As shown in FIGS. 1 and 3, in the electromotive chain saw 10, a chain stop mechanism 40 is driven by a solenoid SL for stopping the chain CH when the trigger lever 15 is turned off. When the trigger lever 15 is returned to its OFF position, the solenoid SL is energized to operate the chain stop mechanism 40.

Figure 4A:
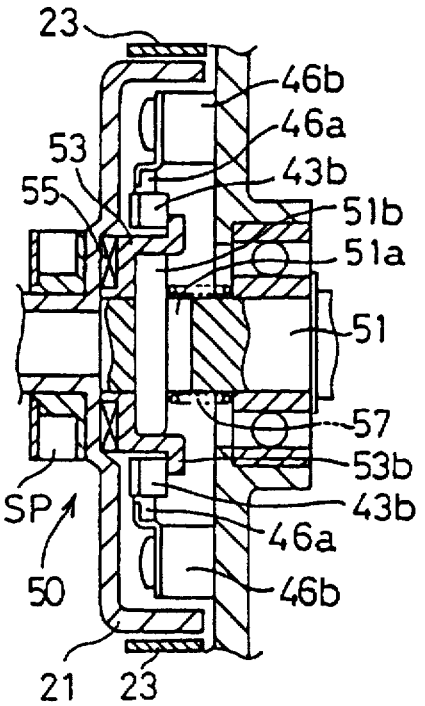
FIG. 4A is a cross-sectional view showing the engagement of a clutch.
Figure 4B:
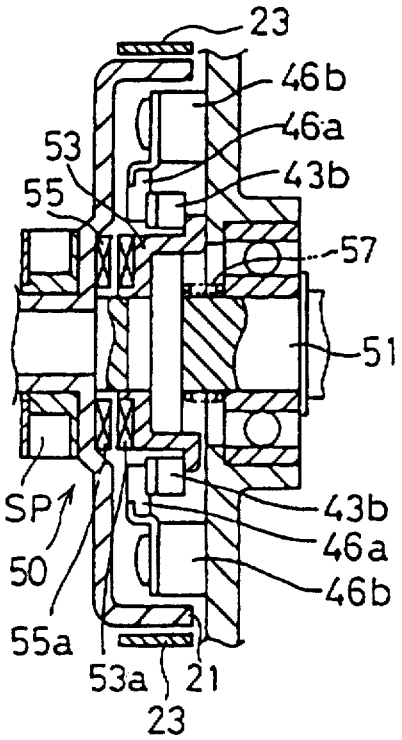
FIG. 4B is a cross-sectional view showing the disengagement of the clutch.
Figure 4C:
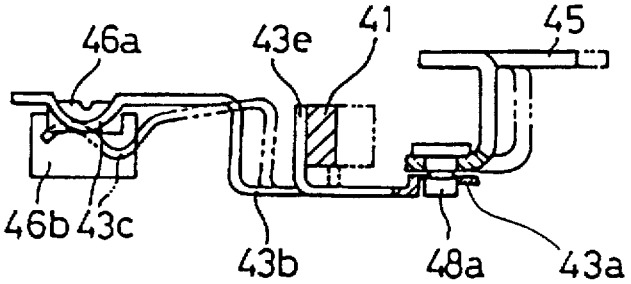
FIG. 4C is an explanatory view showing the interconnection of the clutch and the brake device.
Figure 4D:
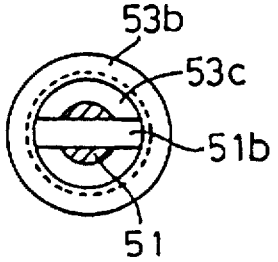
FIG. 4D is an explanatory view showing the engagement of a male clutch member and a rotation shaft.
Figure 5:
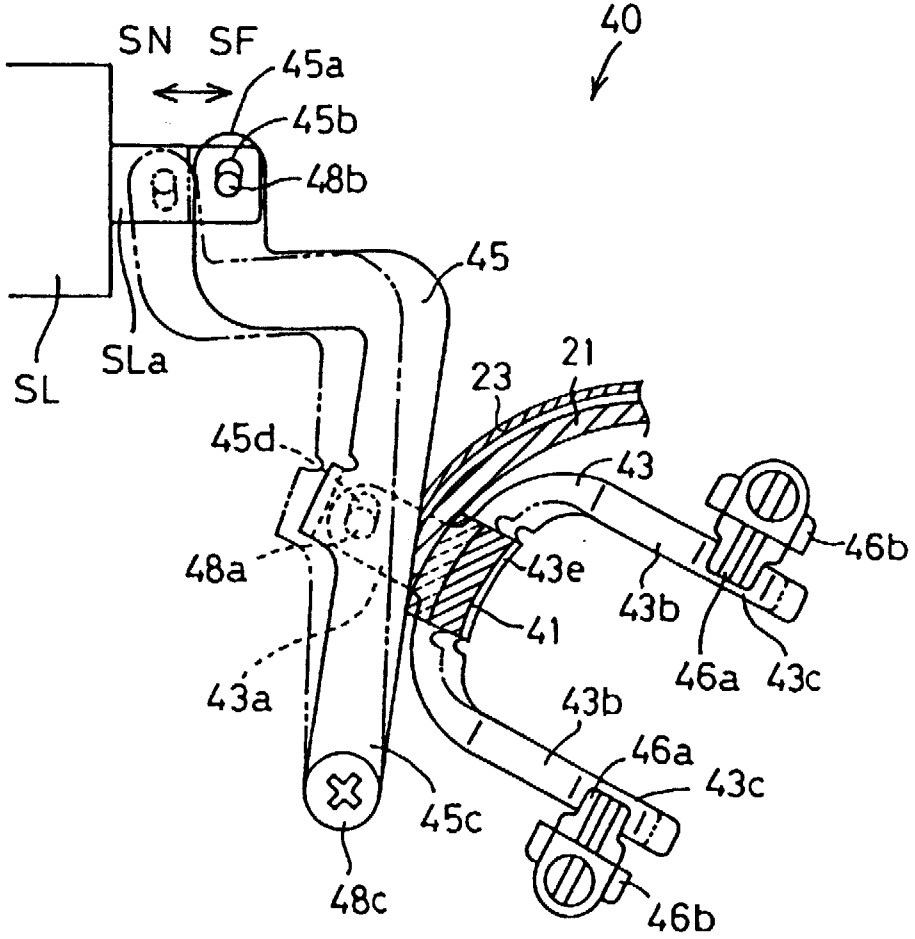
FIG. 5 is an explanatory view of the interconnection of the clutch and the brake device in the electromotive chain saw of the first embodiment.

As shown in FIGS. 4 and 5, the chain stop mechanism 40 is composed of a brake shoe 41 which can be engaged with or disengaged from the inner side faces of brake drum 21, a Y-shaped resilient member 43 for supporting the brake shoe 41, a swingable lever 45 connected with a pin 48*a* to a leg 43*a* of the resilient member 43, and a clutch 50 turned on or off by sliding two spring arms 43*b* of the resilient member 43.

As shown in FIG. 4C, the resilient member 43 is formed by folding a thin metal plate at several points, and has two spring arms 43*b* functioning as a leaf spring. The swingable lever 45 is solidly formed in a folded shape from a thicker metal plate than the plate forming the resilient member 43.

As shown in FIG. 4C, a V-shaped part 43*c* is projected downwards as seen in the figure adjacent to the end of the spring arm 43*b* of the resilient member 43. The V-shaped part 43*c* of spring arm 43*b* is engaged with a V-shaped metal fitting 46*a* projected from a housing block 46*b*.

As shown in FIG. 5, the resilient member 43 and the swingable lever 45 are interconnected with the pin 48*a* engaged in a long hole 45*d*. The long hole 45*d* is formed in the lever 45, and the pin 48*a* is secured to the leg 43*a*, extending to be engaged in the long hole 45*d*. When the swingable lever 45 is moved, the resilient member 43 can be slid smoothly. As shown in FIG. 1, a guide face 48 is provided adjacent the spring arm 43*b* so that resilient member 43 can be slid or guided straight.

The free end 45*a* of swingable lever 45 is connected to solenoid SL with a spring pin 48*b* engaged in a long hole 45*b*, in the same manner as the linkage, such that both the swingable lever 45 and the solenoid SL can be smoothly moved. The opposite end 45*c* of the swingable lever 45 is pivotably supported on a screw 48*c* in the housing. The resilient member 43 is interconnected with an intermediate portion of the swingable lever 45 via the pin 48*a* engaged in the long hole 45*d*.

At the joint among the leg 43*a* and the arms 43*b* of the resilient member 43, the brake shoe 41 is securely supported on an arm 43*e* bent upwards as seen in FIG. 4C.

The clutch 50 is composed of a jawed male clutch member 53 oscillatably connected via a pin 51*b* inserted through a long hole 51*a* formed in a rotation shaft 51 and a female clutch member 55 formed on the inner wall of the brake drum 21. Engagement teeth 53*a* and 55*a* are opposed to the male clutch member 53 and the female clutch member 55, respectively. The male clutch member 53 is normally urged via a coil spring 57 such that teeth 53*a* and 55*a* are engaged with each other. When the teeth 53*a* and 55*a* are disengaged from each other, the brake drum 21 is freed from the rotation shaft 51. Drive force is transmitted to the brake drum 21 via the clutch 50, when the teeth 53*a* and 55*a* are engaged with each other. The rotation shaft 51 is, as shown in FIG. 3, driven via a bevel gear BBG by the motor M.

A jaw 53*b* of male clutch member 53 has an outer diameter of sufficient size so as to contact a portion of the aforementioned spring arm 43*b*. When the V-shaped part 43*c* is engaged with the V-shaped metal fitting 46*a* as shown by the solid line in FIG. 4C, the spring arms 43*b* fails to push against the jaw 53*b* of the male clutch member 53, while the jaw 53*b* of the male clutch member 53 is depressed by the spring arms 43*b* when the V-shaped part 43*c* is ridden over the V-shaped metal fitting 46*a*, as shown by a two-dotted line in FIG. 4C. As shown in FIG. 4D, the male clutch member 53 is provided with a raised part 53c within its cylindrical body, and is engaged with the pin 51b sandwiched by these raised parts 53c.

The operation of chain stop mechanism 40 is now explained referring to FIGS. 4 and 5.

When the solenoid SL is turned off, and an iron core SLa of solenoid SL is projected to position SF in FIG. 5, the swingable lever 45 is positioned as shown by a solid line. Therefore, the bottom of the V-shaped part 43c of the spring arm 43b is engaged with the V-shaped metal fitting 46a. The brake shoe 41 is disconnected from the brake drum 21, and the clutch 50 is engaged as shown in FIG. 4A.

Subsequently, when the rotation shaft 51 is rotated, both the brake drum 21 and the sprocket SP are also rotated, thereby driving the chain CH. Even when the rotation shaft 51 is stopped, the brake shoe 41 is disconnected from the brake drum 21. Therefore, the chain CH can be relatively easily rotated, and is manually accessible, such that the tension of the chain CH can be adjusted and a chain blade can be ground easily.

On the other hand, when the solenoid SL is turned on, the iron core SLa is retracted to position SN in FIG. 5. The swingable lever 45 is attracted toward the solenoid SL as shown by a two-dotted line in FIG. 5, thereby pulling the resilient member 43. Consequently, the resilient member 43 is slid to the position shown by a two-dotted line in FIG. 4C, such that the V-shaped part 43c is ridden over the V-shaped metal fitting 46a. As shown in FIG. 4B, the male clutch member 53 is depressed, thereby disengaging the clutch 50. No rotary force is transmitted from the rotation shaft 51 to the brake drum 21 or the sprocket SP.

As shown by the two-dotted line in FIG. 4C and FIG. 5, the brake shoe 41 is pushed against the inner wall of the brake drum 21, thereby instantly halting the brake drum 21.

The spring arm 43b is of a sufficient size such that the V-shaped part 43c is prevented from going beyond the V-shaped metal fitting 46a completely. Therefore, when the solenoid SL is turned on, the spring arm 43b is entirely urged or curved downwards as seen in the FIG. 4C. The male clutch member 53 is depressed, thereby firmly disengaging the clutch 50. In addition, the spring arm 43b has a resilient force stored therein to return back to its initial position shown by the solid line in FIG. 4C. Therefore, just by turning off the solenoid SL, the spring arm 43b can return to its initial position without requiring any external force.

As aforementioned, when the solenoid SL is turned on, the chain stop mechanism 40 of the embodiment is actuated, thereby stopping the rotation of sprocket SP. When the solenoid SL is turned off, the sprocket SP automatically returns to its initial position, ready for rotation. If the spring arm 43b has a weak force and fails to be returned to its initial position just by turning off the solenoid SL, another spring can be provided for urging the swingable lever 45 back to its initial position.

Figure 6:
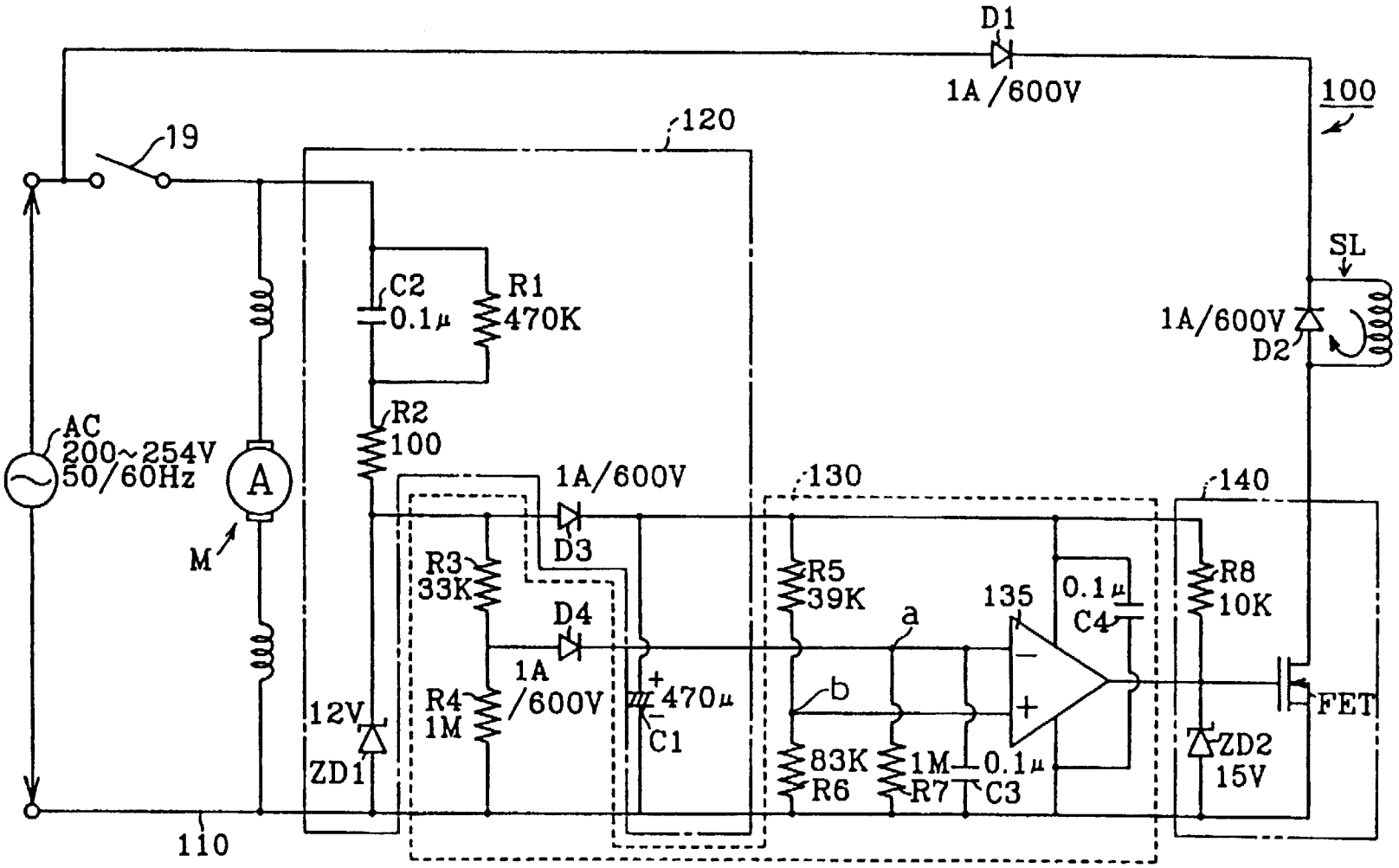
FIG. 6 is a representation of a solenoid drive circuit in the first embodiment.

A drive circuit 100 for the solenoid SL is now explained referring to FIG. 6.

The drive circuit 100 is composed of a motor drive circuit 110 connected to an AC power source, with a capacitor circuit 120, a switch monitoring circuit 130 and a solenoid drive circuit 140 added thereto.

The capacitor circuit 120 is provided with a capacitor C1 of 470 μF, a capacitor C2, resistors R1 and R2 for lowering voltage, and a Zener diode ZD1 for stabilizing voltage and other associated components. While the motor M is driven by turning on the power switch 19, power is stored in the capacitor C1.

The switch monitoring circuit 130 is composed of a comparator 135, resistors R3, R4, R5, R6 for making a difference in voltage between terminals a and b, a resistor R7 for quickly dropping the voltage at the terminal a, and other associated components. Both ends of the capacitor C1 of capacitor circuit 120 are coupled to both ends of a line interconnecting the resistor R5, the terminal b and the resistor R6. When the power switch 19 is turned off, voltage drops more slowly at the terminal b than at the terminal a, because electricity is discharged from the capacitor C1. An RC charge/discharge circuit is formed with the capacitor C1 and resistors R5, R6, such that voltage can drop with a delay at one of the input terminals of comparator 135.

Figure 7:
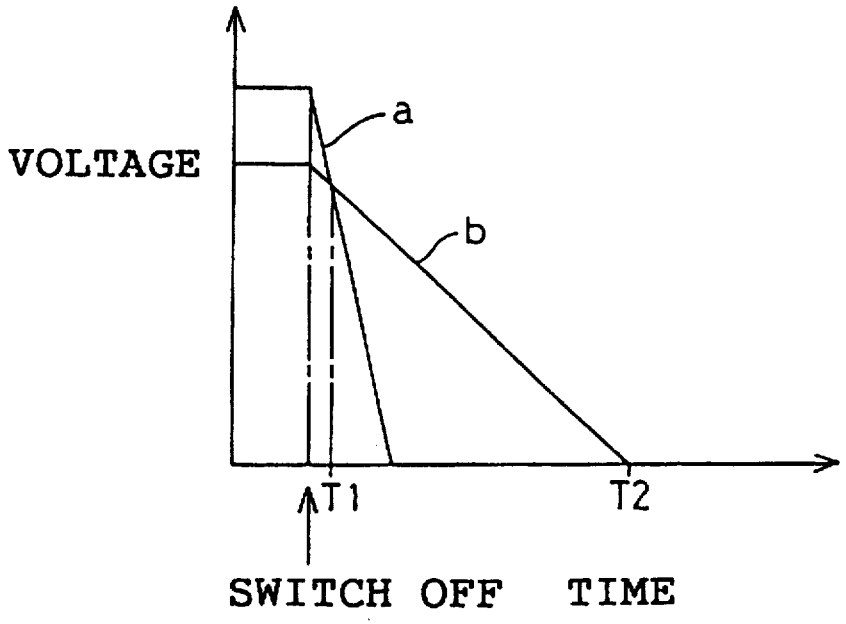
FIG. 7 is a graph explaining the monitoring of voltage in the solenoid drive circuit in the first embodiment.

Consequently, in the switch monitoring circuit 130, while the power switch 19 is switched on, the voltage at terminal a is higher than that at terminal b, and the comparator 135 outputs a low-level signal. At the moment the power switch 19 is switched off, as shown in FIG. 7, the voltages at both the terminals a, b start dropping with a difference in dropping rates. Immediately after the power switch 19 is switched off, the voltage at terminal a lowers to that at terminal b at time T1, at which the output of comparator 135 is at a high level. After further time elapses, the voltage at terminal b is dropped completely at time T2, at which the output of comparator 135 is again at a low level.

As aforementioned, at the moment the power switch 19 is switched off, in the switch monitoring circuit 130, a high-level signal begins to be transmitted. After a predetermined time period elapses from time T1 to T2, a low-level signal is again transmitted from the switch monitoring circuit 130 to the solenoid drive circuit 140.

The solenoid drive circuit 140 is composed of an FET, a resistor R8 for restricting the flow of electric current, and a Zener diode ZD2 for protecting the FET and other associated components. The output of the aforementioned comparator 135 is transmitted to the FET. Therefore, the FET turns on at time T1 immediately after the power switch 19 is turned off, and turns off at time T2.

The solenoid SL is provided in the drive circuit 100 with the FET incorporated therein, and can receive electric power directly from the AC power source, not via the power switch 19. On the upstream side of the drive circuit 100 a diode D1 is provided for half-wave rectification, and on the downstream side the aforementioned FET is provided.

Consequently, the solenoid SL turns on at time T1 immediately after the power switch 19 is switched off, and turns off at time T2.

Figure 8:
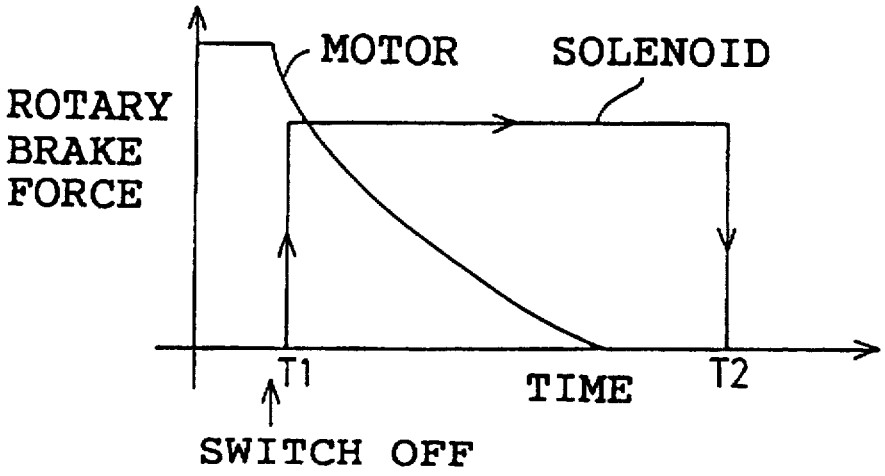
FIG. 8 is a graph showing the relationship between a solenoid drive time period and a motor stop time period in the first embodiment.

As shown in FIG. 8, the time period between T1 and T2, during which electricity is conducted to the solenoid SL, is established such that the motor M can be firmly stopped while the solenoid SL is turned on. When the solenoid SL is again turned off, the motor M is completely stopped, thereby preventing the chain CH from being driven again.

In the aforementioned drive circuit 100, capacitors C3 and C4 for stabilizing voltage, a free wheeling diode D2 for protecting the FET and making the solenoid SL free-wheeling, and diodes D3 and D4 for half-wave rectification are also arranged.

As aforementioned, in the first embodiment, immediately after the trigger lever 15 is released and the power switch 19 is turned off, the solenoid SL is turned on only for a set term, the rotation shaft 51 is disconnected from the brake drum 21 and the sprocket SP by the clutch 50, and the brake drum 21 is stopped. Since the clutch 50 is disconnected and the brake drum 21 is stopped, the rotation of sprocket SP is quickly stopped. After a predetermined time elapses, the solenoid SL again turns off. At this time, the motor M is already stopped. Therefore, the sprocket SP is prevented from being driven again. When the solenoid SL is turned off, the chain stop mechanism 40 automatically returns to the initial condition, and the chain CH can be easily pulled and rotated manually. In addition, the chain CH is accessible for maintenance. Subsequently, when the trigger lever 15 is gripped, the output of comparator 135 maintains its low level without inhibiting the chain CH from being driven, until the trigger lever 15 is released.

Power is supplied to the solenoid SL and the motor M in common from the AC power source. While the solenoid SL is turned on, necessary electric power is stably supplied to the solenoid SL, and the secure operation of chain stop mechanism 40 is assured. If the motor M and the solenoid SL are provided with a power source, respectively, each power source requires its own battery, thereby undesirably enlarging the entire size of the chain saw. The common AC power source as in the embodiment is desirable.

Figure 9A:
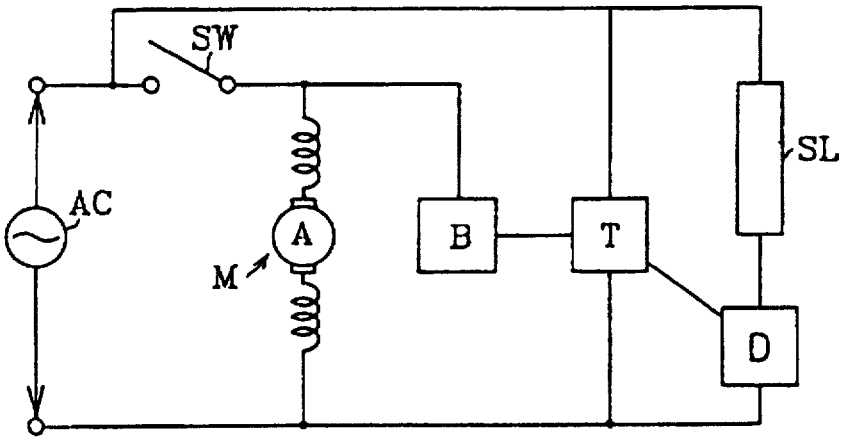
FIGS. 9A and 9B are representations of modifications in the solenoid drive circuit.

Modified circuits are now explained. As shown in FIG. 9A, a voltage monitoring circuit B for monitoring the switching condition, a digital timer T which can be reset to start when the voltage monitoring circuit B detects the switching off condition, and a solenoid drive circuit D for continuing the transmission of drive signals from when the digital timer T starts its operation till the digital timer T stops its operation can be arranged. Also in such a circuit, drive power is supplied to the solenoid SL from the common AC power source.

Figure 9B:
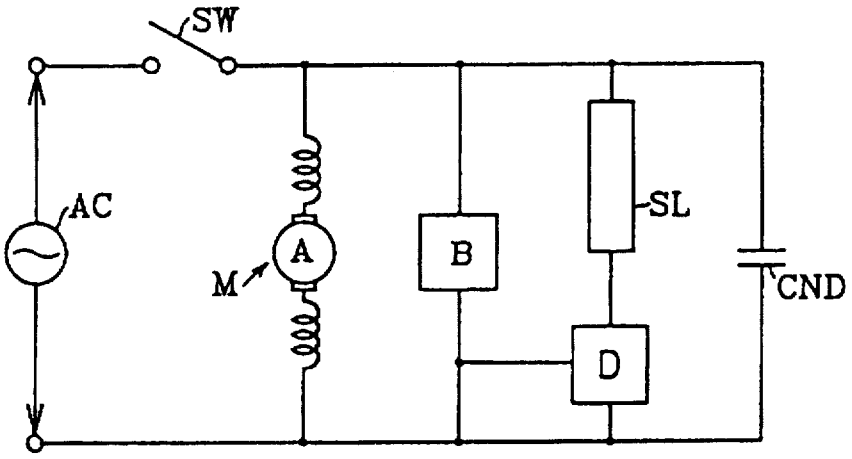

Alternatively, as shown in FIG. 9B, in addition to the voltage monitoring circuit B and the solenoid drive circuit D for transmitting drive signals when the voltage monitoring circuit B detects the switching off condition, a capacitor CND for storing electric power required for driving the solenoid SL while a switch SW is turned on can be arranged.

In both modifications, the solenoid SL can be turned on for a predetermined time period after the switch SW is turned off. When drive electric power is supplied from capacitor CND to solenoid SL, however, the capacitor CND needs to be large sized. Therefore, the entire size of the chain saw is disadvantageously enlarged.

A second embodiment is now explained referring to FIGS. 10–13.

Figure 10:
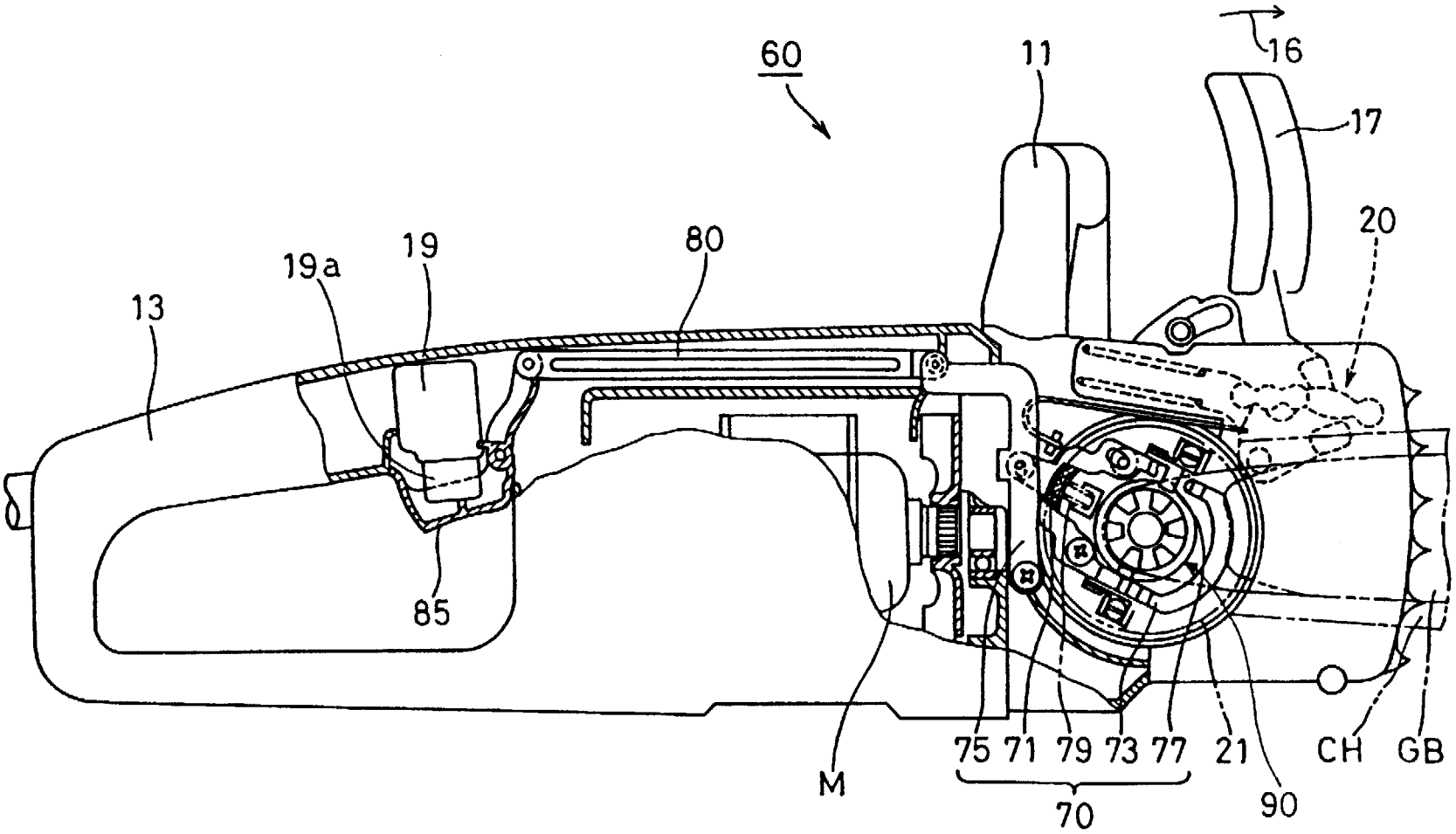
FIG. 10 is a partly broken front view of an electromotive chain saw according to a second embodiment.
Figure 11:
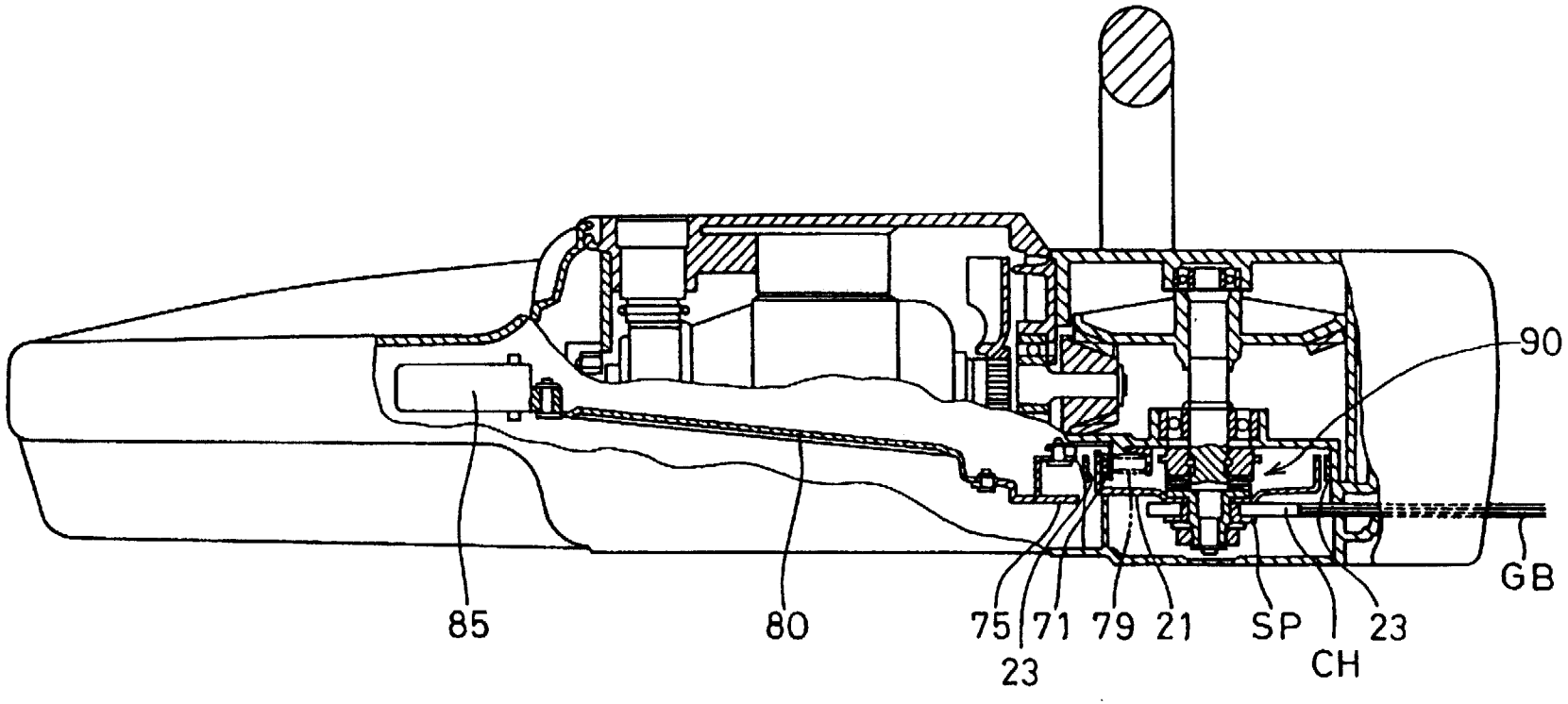
FIG. 11 is a partly broken plan view of the electromotive chain saw of the second embodiment.

As shown in FIG. 10, in the second embodiment, an electromotive chain saw 60 has a structure similar to the electromotive chain saw 10 of the first embodiment. Differently from the first embodiment, however, instead of the solenoid SL, a chain stop mechanism 70 is driven by a linkage when a trigger member 85 is released, thereby disconnecting a clutch 90 and stopping the brake drum 21. The brake device, operated by turning the hand guard 17 in the direction shown by the arrow 16, is identical to the corresponding device of the first embodiment.

Figure 12A:
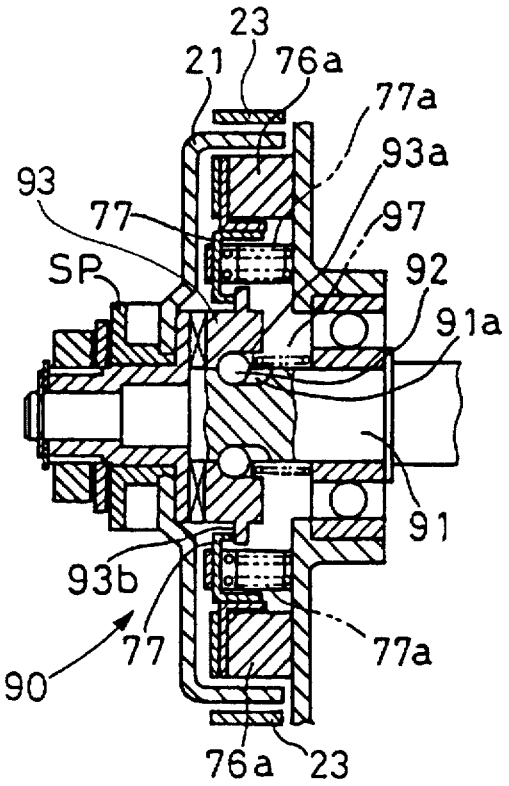
FIG. 12A is a cross-sectional view showing the engagement of a clutch.
Figure 12B:
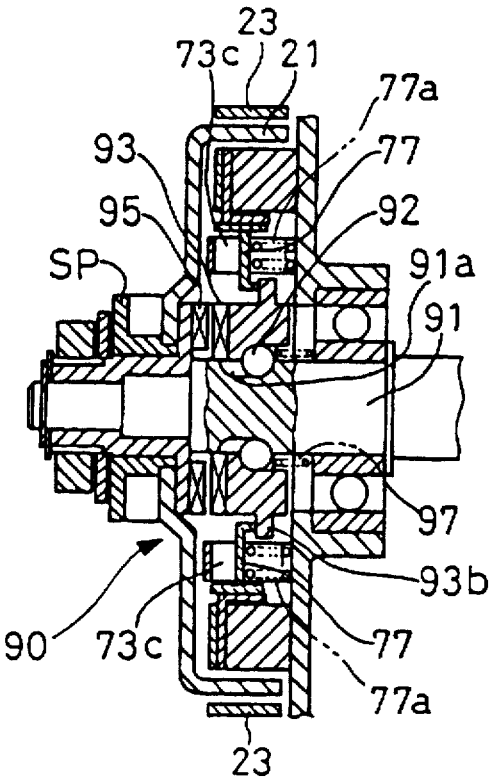
FIG. 12B is a cross-sectional view showing the disengagement of the clutch.
Figure 12C:
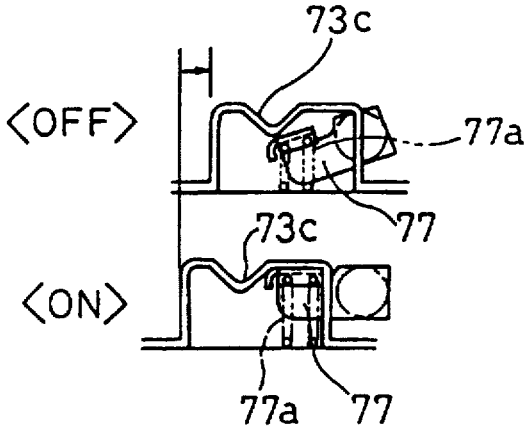
FIG. 12C is an explanatory view showing the movement of a swingable detent when the clutch is engaged or disengaged.
Figure 13:
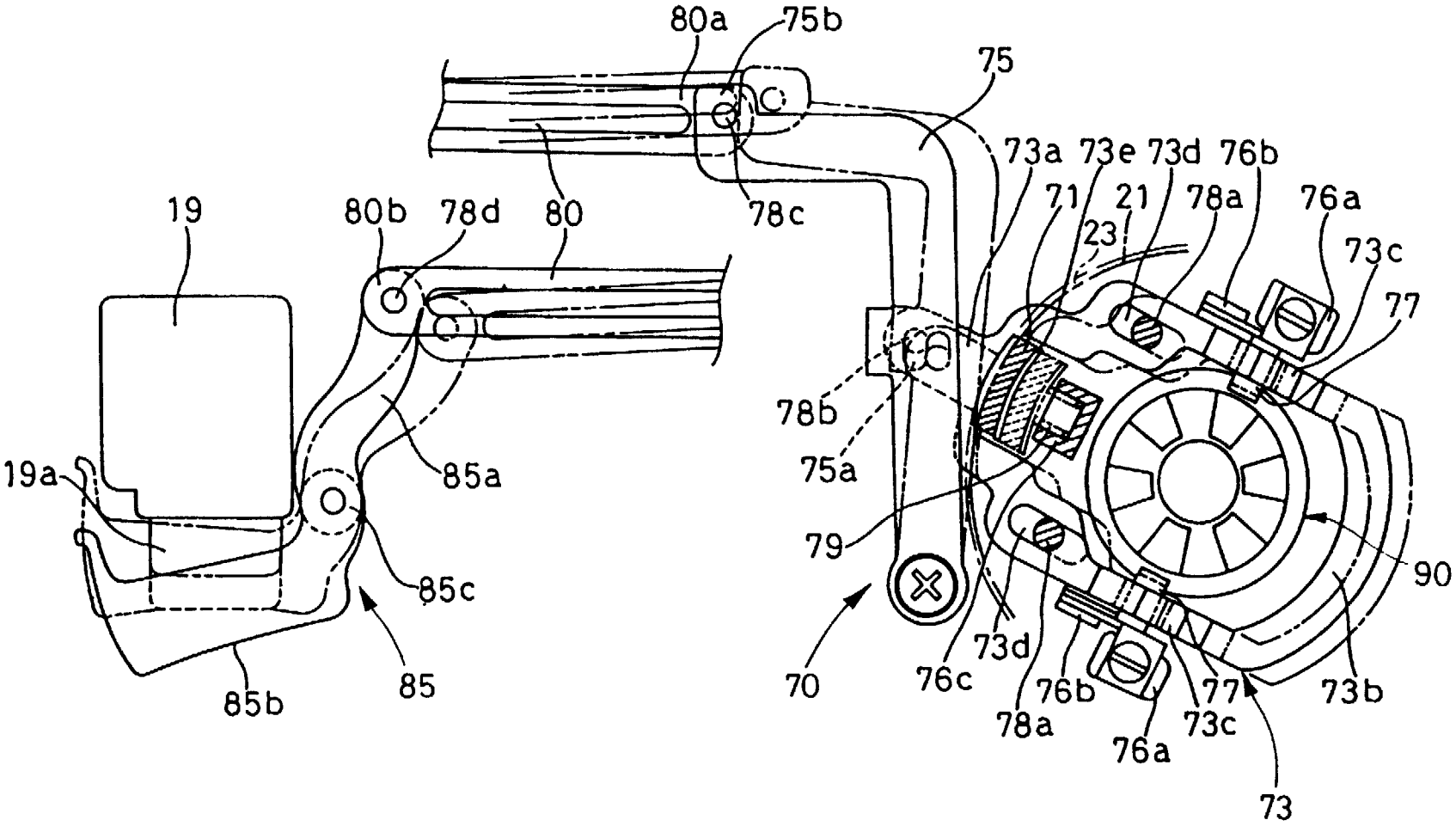
FIG. 13 is an explanatory view of the interconnection of the clutch and the brake device in the electromotive chain saw of the second embodiment.

As shown in FIGS. 12 and 13, the chain stop mechanism 70 has a structure similar to that of the chain stop mechanism 40 of the first embodiment. The chain stop mechanism 70 is composed of a brake shoe 71, a metal support fitting 73 having a shape similar to that of a ball playing racket for supporting the brake shoe 71, a swingable lever 75 connected with a pin **78*b* to an arm 73*a* of metal support fitting 73, and the clutch 90 turned on or off with a frame 73*b* of metal support fitting 73**.

As shown in FIG. 12C, the metal support fitting 73 is bent into an M shaped part **73*c*. Such formed M-shaped part 73*c* is in contact with the top of a swingable detent 77 secured, as seen in FIG. 13, with a rivet 76*b* to a block 76*a* in a housing. The swingable detent 77 is normally urged clockwise as seen in FIG. 12C by a spring 77*a*. As shown in FIG. 13, the frame 73*b* is restricted in its movement, or guided, by a screw 78*a* securely inserted in a long hole 73*d* formed in the frame 73*b***.

As shown in FIG. 13, the metal support fitting 73 and the swingable lever 75 are interconnected with the pin **78*b* inserted in a long hole 75*a* in the same manner as the first embodiment. When the swingable lever 75 is operated, the metal support fitting 73** can be slid smoothly.

The brake shoe 71 is fixedly supported on an arm **73*e* raised on the root surface of arm 73*a* of metal support fitting 73, and urged or pushed against the brake drum 21 by a coil spring 79 housed in a case 78*c* formed adjacent the raised arm 73*e***.

The free end **75*b* of swingable lever 75 is connected with a pin 78*c* to one end 80*a* of a link rod 80. The other end 80*b* of link rod 80 is connected with a pin 78*d* to the tip of an arm 85*a* of trigger member 85**.

As shown in FIGS. 10 and 13, the trigger member 85 is rotated about a support **85*c* at the forward end of a tab 85*b* which can be manually depressed. The support 85*c* is interposed between the tab 85*b* and the arm 85*a*. As shown in FIG. 13, when the trigger member 85 is gripped, the arm 85*a* is rotated clockwise about the support 85*c*, thereby pushing the link rod 80 forward as shown by a two-dotted line in FIG. 13. When the trigger member 85 is released, the trigger member 85 is rotated counterclockwise by the urging force of pushing button 19*a* of power switch 19 and the urging force of the coil spring 79 behind the brake shoe 71, thereby returning the link rod 80 to the initial position, as shown by a solid line in FIG. 13**.

When the trigger member 85 is depressed, a compression load is applied to the link rod 80. Therefore, the link rod 80, formed by pressing a metal plate, is bulged in its middle so as to have an improved buckling strength.

As shown in FIGS. 12A and 12B, the clutch 90 has a structure similar to that of the clutch 50 of the first embodiment. The clutch 90 is composed of a male clutch member 93 formed integral with and rotatable about a rotation shaft 91 and slidable in an axial direction, a female clutch member 95 provided on the brake drum 21, and a coil spring 97 for urging the male clutch member 93 toward the female clutch member 95. One pair of axial grooves **91*a* is spaced apart at an angle of 90 degrees from the other pair of grooves 91*a*, about the rotation shaft 91. Grooves 93*a* are formed in the male clutch member 93, corresponding to the grooves 91*a*. The male clutch member 93 is fixedly attached to the rotation shaft 91 via steel balls 92 received between the grooves 91*a* and 93*a*, such that the male clutch member 93 is integral with the rotation shaft 91 about the rotation axis and is also slidable in the axial direction. The male clutch member 93 is provided with a jaw 93*b* having an outer diameter of sufficient size to contact the swingable detent 77. When the swingable detent 77 is depressed by the M-shaped part 73*c*, the jaw 93*b* is also depressed, thereby releasing the clutch 90**.

The operation of chain stop mechanism 70 is now explained referring to FIGS. 12 and 13.

When the trigger member 85 is released, the link rod 80 and the swingable lever 75 are in the position shown by a solid line in FIG. 13. The M-shaped part **73*c* is lowered to depress the swingable detent 77 as shown in the upper figure of FIG. 12C. In the clutch 90, as shown in FIG. 12B, the male and female clutch members 93 and 95 are disconnected from each other, and no rotary force is transmitted from the rotation shaft 91 to the brake drum 21 and the sprocket SP. In addition, the brake shoe 71 is moved to the position shown by a solid line in FIG. 13 such that the brake shoe 71 is urged by the coil spring 79, thereby stopping the brake drum 21 and the sprocket SP. Therefore, when the trigger member 85 is released, the clutch 90 is immediately released, and the brake force is applied by the brake shoe 71**, thereby instantly stopping the chain CH.

When the trigger member 85 is gripped, the link rod 80 and the swingable lever 75 are moved to the position shown by a two-dotted line in FIG. 13. The M-shaped part 73*c* applies no depressing force to the swingable detent 77 as shown in the lower figure of FIG. 12C. The swingable detent 77 is rotated clockwise as seen in FIG. 13 by the urging force of the coil spring 97 via the jaw 93*b* of male clutch member 93 and by the urging force of the spring 77*a*. In the clutch 90, as shown in FIG. 12A, the male and female clutch members 93 and 95 are engaged with each other. The brake shoe 71 is returned to the position shown by the two-dotted line in FIG. 13, in which the coil spring 79 is compressed. No brake force is applied to the brake drum 21 and the sprocket SP any longer. Therefore, when the trigger member 85 is gripped, the clutch 90 is immediately engaged and no brake force is applied by the brake shoe 71. Drive force is instantly transmitted from the motor M to the sprocket SP, thereby rotating the chain CH.

In the second embodiment, the chain CH can be stopped quickly only by the mechanism when the trigger member is released, which requires less cost than the first embodiment.

In the two embodiments, the V-shaped part 48*c* and the M-shaped part 73*c* are provided at the predetermined positions, such that as the clutch first begins to be released, and after the clutch is released, the brake force is applied. The time the clutch is released is deviated from the time the brake force is applied. Therefore, brake force can be easily applied.

In the two embodiments, the clutch is released and the brake device is operated, using the action of a lever. In the first embodiment, a strong brake force is applied without requiring a large magnetic force of a solenoid. The size and cost of the device can be minimized. In the second embodiment, the trigger member can be gripped without requiring a strong gripping force, thereby giving an operator comfort.

This invention has been described above with reference to the preferred embodiments as shown in the figures. Modifications and alterations may become apparent to one skilled in the art upon reading and understanding the specification. Despite the use of the embodiments for illustration purposes, the invention is intended to include all such modifications and alterations within the spirit and scope of the appended claims.

For example, in the first embodiment, the clutch is released and the brake device is switched on with a single solenoid. Drive members can be provided for the clutch and the brake device, respectively.

In the first embodiment, the teeth 53*a* and 55*a* formed in the axial direction relative to the rotation shaft 51 are engaged with each other like teeth. They can be splined for interconnection. Different from the conventional clutch using frictional force, the spring 57 of this embodiment does not require structural strength, and the clutch can be easily disconnected from the brake drum.

The interconnecting mechanism between the male clutch members 53, 93 and the rotational shafts 51, 91 is not limited to the pin 51 inserted in the long hole 51*a* and the steel ball 92 engaged in the grooves 91*a*, 93*a*, and it can be a splined interconnection.

What is claimed is:

1. An electromotive chain saw, having a chain stop device, comprising:

a cutting chain wound around a guide bar extending forwards from a housing;

an electromotive motor for providing a rotary drive force via a clutch to a sprocket onto which said cutting chain is wound; and a trigger member for energizing said electromotive motor when turned on and for stopping said electromotive motor when turned off, said chain stop device comprising;

a clutch release member for releasing the engagement of said clutch;

a brake member for applying a brake force to a brake drum secured onto said sprocket; and a trigger link means for operating said clutch release member and said brake member when said trigger member is moved from an ON position to an OFF position.

2. An electromotive chain saw according to claim 1, wherein said clutch comprises:

an engagement tooth formed on said brake drum;

an engagement member, being rotated together with a rotation shaft rotated by said electromotive motor and being slidable in an axial direction relative to said rotation shaft, for engaging with said engagement tooth on said brake drum; and an urging member for at least one of urging and pushing said engagement member onto said brake drum;

said clutch release member releases the engagement of said clutch by pushing back said engagement member against said urging member.

3. An electromotive chain saw according to claim 2, wherein said brake member comprises a brake shoe for applying a brake force to a peripheral wall of said brake drum, said engagement member is provided with a jaw, said clutch release member is composed of a slidable member which is slidable in a direction perpendicular to said rotation shaft, and a detent is formed on said slidable member to be projected into said jaw of said engagement member, and the engagement of said clutch is released when said slidable member is slid to a position in which said detent is brought in at least one of direct and indirect contact with said jaw, and said brake shoe is attached to said slidable member, such that a brake force is applied to said brake drum when said detent is slid to be in at least one of direct and indirect contact with said jaw.

4. An electromotive chain saw according to claim 3, wherein said trigger link means comprises a trigger release detecting means for detecting that said trigger member is changed from said ON position to said OFF position, and a clutch release start means for operating said clutch release member when said trigger release detecting means detects that said trigger member is changed to said OFF position, and said clutch release start means comprises a solenoid for slidably guiding said slidable member and an electric power supply means for supplying an electric power to said solenoid.

5. An electromotive chain saw according to claim 4, wherein said solenoid and said slidable member are interconnected with a lever interposed therebetween, and a point of application interconnecting said lever and said slidable member is positioned between a support of said lever and a force point interconnecting said lever and said solenoid.

6. An electromotive chain saw according to claim 4 comprising:

a drive circuit comprising a motor drive circuit connected to an AC power supply source via a switch;

a capacitor circuit connected to said motor drive circuit;

a switch monitoring circuit for detecting a condition of said motor drive circuit; and a solenoid drive circuit connected to said motor drive circuit and said switch monitoring circuit.

7. An electromotive chain saw according to claim 6 wherein said capacitor circuit comprises:

a first capacitor;

a first resistor connected in parallel to said first capacitor;

a second resistor connected in series to said first capacitor;

a Zener diode connected in series with said second resistor; and a second capacitor connected in parallel with said Zener diode.

8. An electromotive chain saw according to claim 7 comprising a diode connected in series between said second resistor and said second capacitor.

9. An electromotive chain saw according to claim 6 wherein said switch monitoring circuit comprises:

a comparator;

a plurality of resistors for making a difference in voltage between input terminals of said comparator; and a resistor for quickly dropping a voltage at one of said input terminals.

10. An electromotive chain saw according to claim 9 comprising:

a diode connected to said one of said input terminals;

a first capacitor connected to said one of said input terminals; and a second capacitor connected in parallel with said resistor.

11. An electromotive chain saw according to claim 6 wherein said solenoid drive circuit comprises:

a field effect transistor;

a resistor for restricting a flow of electric current; and a Zener diode for protecting said field effect transistor.

12. An electromotive chain saw according to claim 6 comprising:

a first diode connected in series with said solenoid drive circuit; and a second diode connected in series with said first diode;

said solenoid is connected in parallel with said first diode.

13. An electromotive chain saw according to claim 4 comprising:

an AC power supply source connected to said electromotive motor via a switch;

a voltage monitoring circuit for monitoring a condition of said switch;

a timer which can be reset to start when said voltage monitoring circuit detects an off condition in said switch;

and a solenoid drive circuit for continuing drive signals to said solenoid from when said timer starts its operation until said timer stops its operation.

14. An electromotive chain saw according to claim 4 comprising:

an AC power supply source connected to said electromotive motor via a switch;

a voltage monitoring circuit for monitoring a condition of said switch;

a solenoid drive circuit for providing drive signals to said solenoid; and a capacitor for storing power required to drive said solenoid while said switch is in an on position.

15. An electromotive chain saw according to claim 3, wherein said trigger link means comprises a rod member mechanically connected to said trigger member for providing a stroke movement when said trigger member is operated between said ON position and said OFF position, and said rod member is interconnected to said clutch release member such that said clutch release member is operated when said trigger member is moved to said OFF position.

16. An electromotive chain saw according to claim 15, wherein said slidable member is provided with a brake urging member for urging said brake shoe toward said brake drum, said rod member is brought in at least one of direct and indirect contact with said slidable member, such that the stroke movement of said rod member attenuates the urging force of said brake urging member when said trigger member is gripped, and the stroke movement of said rod member releases the urging force of said brake urging member when said trigger member is released.

17. An electromotive chain saw according to claim 16 wherein said rod member and said slidable member are interconnected indirectly with a lever interposed therebetween, and a point of application interconnecting said lever and said slidable member is positioned between a support of said lever and a force point interconnecting said lever and said rod member.

18. An electromotive chain saw according to claim 1, wherein said clutch release member engages with said brake member, and activation of said clutch release member releases the engagement of said clutch release member with said clutch which causes said brake member to apply a brake force to said brake drum.

19. An electromotive chain saw according to claim 1, wherein said trigger member has a brake release means for releasing a brake force applied by said brake member before said trigger member is again moved to said ON position.

* * * * *